US010877428B2

(12) United States Patent
Sako et al.

(10) Patent No.: US 10,877,428 B2
(45) Date of Patent: Dec. 29, 2020

(54) DEVELOPING DEVICE AND IMAGE FORMING APPARATUS

(71) Applicant: FUJI XEROX CO., LTD., Tokyo (JP)

(72) Inventors: Kiyoshi Sako, Kanagawa (JP); Eriko Kokubun, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/663,842

(22) Filed: Oct. 25, 2019

(65) Prior Publication Data

US 2020/0310338 A1 Oct. 1, 2020

(30) Foreign Application Priority Data

Apr. 1, 2019 (JP) ..... 2019-069930

(51) Int. Cl.
*G03G 15/08* (2006.01)
*G03G 21/16* (2006.01)

(52) U.S. Cl.
CPC ..... *G03G 21/1647* (2013.01); *G03G 15/0882* (2013.01)

(58) Field of Classification Search
CPC ..... G03G 21/1647; G03G 15/0881; G03G 15/0882; G03G 15/0884
See application file for complete search history.

(56) References Cited

U.S. PATENT DOCUMENTS 6,055,388 A * 4/2000 Watanabe ..... G03G 15/0849 399/58
2011/0123229 A1 5/2011 Takashima et al.
2013/0308979 A1* 11/2013 Matsuzaki ..... G03G 15/0874 399/111

FOREIGN PATENT DOCUMENTS

JP 4560639 B2 10/2010
JP 5392024 B2 1/2014

* cited by examiner

*Primary Examiner* — Hoang X Ngo
(74) *Attorney, Agent, or Firm* — Sughrue Mion, PLLC

(57) ABSTRACT

A developing device includes: a developer storage unit that stores a developer; a developer transporting unit that is connected to the developer storage unit through an opening portion; a closing member that openably closes the opening portion; and a loosening section that acts simultaneously with opening of the opening portion by the closing member to loosen the developer at an inner end portion of the developer storage unit, opposite to the opening portion.

11 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2019-069930 filed Apr. 1, 2019.

BACKGROUND

(i) Technical Field

The present disclosure relates to a developing device and an image forming apparatus.

(ii) Related Art

JP-B-4560639 discloses a developing device that develops a latent image formed on an image carrier. The developing device includes a device main body, a developer collection unit, a sealing member, and a protrusion member. In the device main body, a developer for developing the latent image is collected, and a developer carrier in which the developer is carried is disposed at a position facing the image carrier. The developer to be supplied to the device main body is collected in the developer collection unit, and the developer collection unit communicates with the device main body via an opening provided above the device main body. The sealing member seals the opening and opens the opening when the developer collected in the developer collection unit is supplied to the device main body. The protrusion member is integrated with the sealing member and protrudes into the developer collection unit. The protrusion member moves in conjunction with an operation in which the sealing member opens the opening, and thereby loosening a lump of the developer collected in the developer collection unit.

JP-B-5392024 discloses a developing device. The developing device includes a developer holding member, a developing container, a developer collection unit, a partition member, and a breaking member. The developer holding member extends in a medium width direction intersecting a transport direction of a medium on which an image is recorded, is disposed to face an image holding member in which a latent image is formed on the surface, and rotates in a state of holding the developer on the surface of the developer holding member. The developing container has a holding-member accommodation portion in which the developer holding member is accommodated, and the developer is collected in the developing container. The developer collection unit is connected to the developing container through an inflow port, and the developer flowing into the developing container is collected in the developer collection unit. The partition member is disposed in the developer collection unit and partitions a space in the developer collection unit. The breaking member includes a breaking portion and a lead portion, and breaks the developer in the developer collection unit in a manner that the breaking portion moves in a direction intersecting one surface and another side surface of the partition member. The breaking portion is disposed in the developer collection unit and is disposed along one side surface and another side surface of the partition member which partitions the developer collection unit. The lead portion is connected to the breaking portion and extends to the outside of the developer collection unit from a breaking outlet formed in the developer collection unit.

SUMMARY

Aspects of non-limiting embodiments of the present disclosure relate to providing a developing device and an image forming apparatus in which the amount of a developer in a developer transporting unit can be prevented from becoming excessive or deficient when the developer is supplied to the developer transporting unit from a developer storage unit storing the developer.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a developer storage unit that stores a developer; a developer transporting unit that is connected to the developer storage unit through an opening portion; a closing member that openably closes the opening portion; and a loosening section that acts simultaneously with opening of the opening portion by the closing member to loosen the developer at an inner end portion of the developer storage unit, opposite to the opening portion.

BRIEF DESCRIPTION OF THE DRAWINGS

Exemplary embodiments of the present invention will be described in detail based on the following figures, wherein:

FIG. 9A illustrates an initial state, FIGS. 9B to 9E illustrate states in the middle, and FIG. 9F illustrates a state where pulling is completed.

DETAILED DESCRIPTION

Next, an exemplary embodiment of the present disclosure will be described with reference to the drawings.

Figure 1:
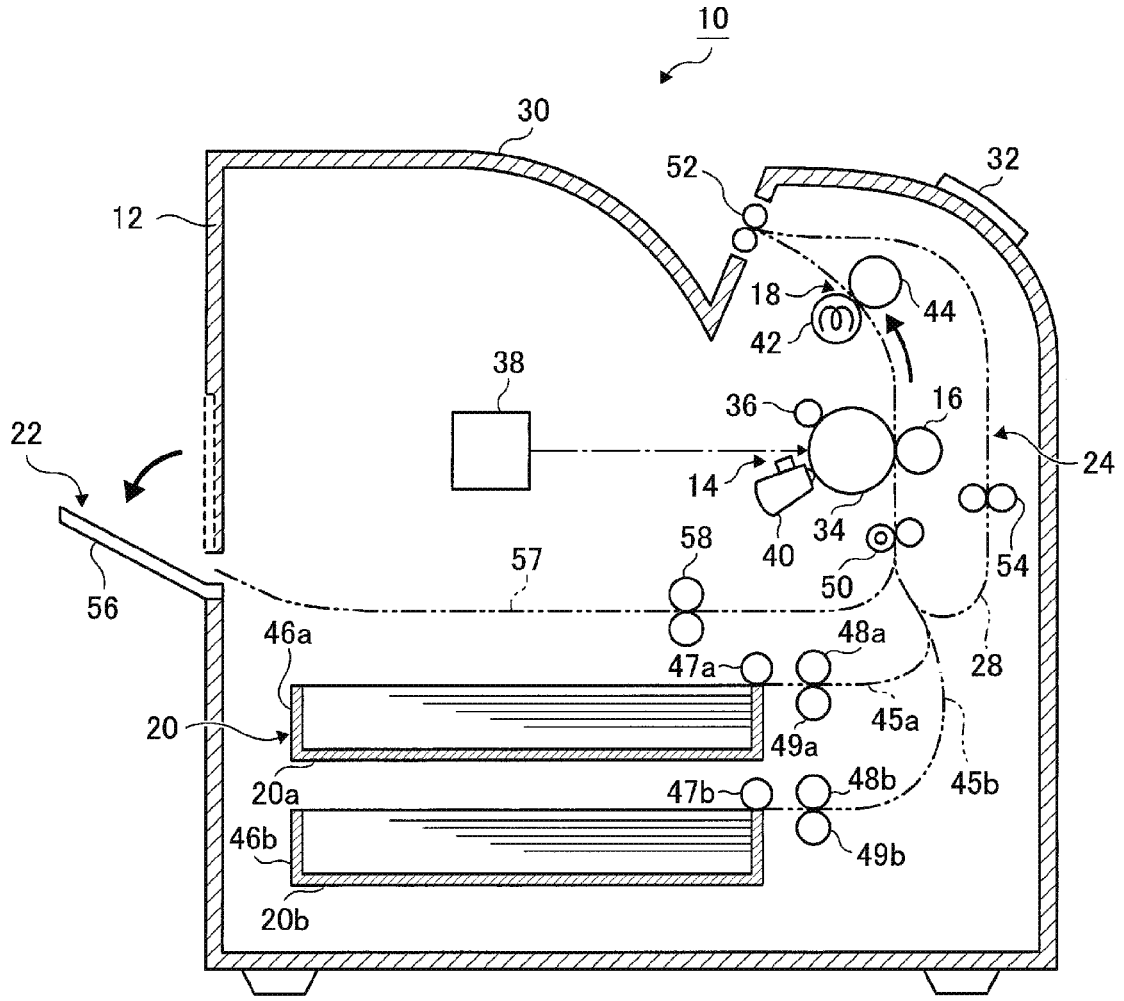
FIG. 1 is a sectional view illustrating an image forming apparatus according to an exemplary embodiment of the present disclosure.

FIG. 1 illustrates an image forming apparatus 10 according to an exemplary embodiment of the present disclosure. The image forming apparatus 10 includes an image-forming-apparatus main body 12. In the image-forming-apparatus main body 12, an image forming unit 14, a transfer device 16, a fixing device 18, a recording-medium supply device 20, a manual supply device 22, and a re-transport device 24 are provided. The image forming unit 14 forms a toner image on a recording medium. The transfer device 16 transfers the toner image formed by the image forming unit 14, to the recording medium. The fixing device 18 fixes the toner image transferred to the recording medium by the transfer device 16, on the recording medium. The recording-medium supply device 20, the manual supply device 22, and the re-transport device 24 are used for supplying a recording medium to the image forming unit 14.

The upper portion of the image-forming-apparatus main body 12 is used as an exit unit 30 to which the recording medium exits. For example, an operation unit 32 such as a touch panel, which is used for operating the image forming apparatus 10, is provided on the front side (right side in FIG. 1) of the image-forming-apparatus main body 12. The operation unit 32 displays control information, instruction information, and other information of the image forming apparatus 10 and receives an input of instruction information and other information from a user. That is, the user may operate the image forming apparatus 10 with the operation unit 32.

The image forming unit 14, which is electrophotographic, includes an image holding member 34 including a photoconductor, a charging device 36, an exposure unit 38, and a developing device 40. The charging device 36 includes, for example, a charging roll that uniformly charges the image holding member 34. The exposure unit 38 scans the image holding member 34, charged by the charging device 36, with light to form an electrostatic latent image. The developing device 40 visualizes the latent image on the image holding member 34, which is formed by the exposure unit 38. The developing device 40 will be described later in detail. In another exemplary embodiment, the exposure unit 38 may use an LED, a surface emitting laser, or any other light source.

The fixing device 18 includes a heating roll 42 and a pressure roll 44. The heating roll 42 includes a heat source therein. The pressure roll 44 is pressed on the heating roll 42. The fixing device 18 fixes a toner image, formed by the image forming unit 14, on a recording medium by heating and pressing the toner image transferred to the recording medium.

The recording-medium supply device 20 is provided at a lower portion of the image-forming-apparatus main body 12 and supplies a recording medium to the image forming unit 14. The recording-medium supply device 20 includes a first supply device 20*a* and a second supply device 20*b*. The first supply device 20*a* and the second supply device 20*b* may store recording media having different dimensions such as thicknesses or sizes and may supply recording media having different dimensions such as thicknesses or sizes to the image forming unit 14.

The first supply device 20*a* and the second supply device 20*b* include recording medium storage containers 46*a* and 46*b*. Recording media are stored as a stack in the recording medium storage containers 46*a* and 46*b*. The recording medium storage containers 46*a* and 46*b* include delivery rolls 47*a* and 47*b* that deliver each recording medium from the recording medium storage containers 46*a* and 46*b*. In addition, the recording medium storage containers 46*a* and 46*b* include paper feeding rolls 48*a* and 48*b* and handling rolls 49*a* and 49*b*. The paper feeding rolls 48*a* and 48*b* transport the recording medium transported from the delivery rolls 47*a* and 47*b* toward a registration roll 50 along sheet feeding transporting paths 45*a* and 45*b* downstream of the delivery rolls 47*a* and 47*b* in the direction of transport of the recording medium. The handling rolls 49*a* and 49*b* are provided to face the paper feeding rolls 48*a* and 48*b*.

The manual supply device 22 is disposed on a side (left side in FIG. 1) of the image-forming-apparatus main body 12. The manual supply device 22 includes a manual placement portion 56 on which a recording medium is placed, and a delivery roll 58 that delivers the recording medium placed on the manual placement portion 56 toward the registration roll 50 along a manual transporting path 57. The manual placement portion 56 opens when rotated in a direction indicated by an arrow illustrated in FIG. 1 and is openably and closably supported by the image-forming-apparatus main body 12.

An exit roll 52 is provided downstream of the fixing device 18 in the direction of transport of the recording medium. The rotation direction of the exit roll 52 can be switched so that the recording medium transported from the fixing device 18 can exit to the exit unit 30 when the exit roll 52 is rotated in one direction. When rotated in another direction, the exit roll 52 feeds the recording medium from the exit unit 30 side into the image-forming-apparatus main body 12, and supplies the recording medium to a reversal transporting path 28.

The reversal transporting path 28 is used to turn upside down the recording medium with a developer image fixed on one surface by the fixing device 18 and to transport the recording medium to the image forming unit 14 again, in which the recording medium is transported from the exit roll 52 to upstream of the registration roll 50. A reversal transporting roll 54 that is driven to rotate is disposed along the reversal transporting path 28. The reversal transporting path 28 and the reversal transporting roll 54 constitute the re-transport device 24.

Figure 2:
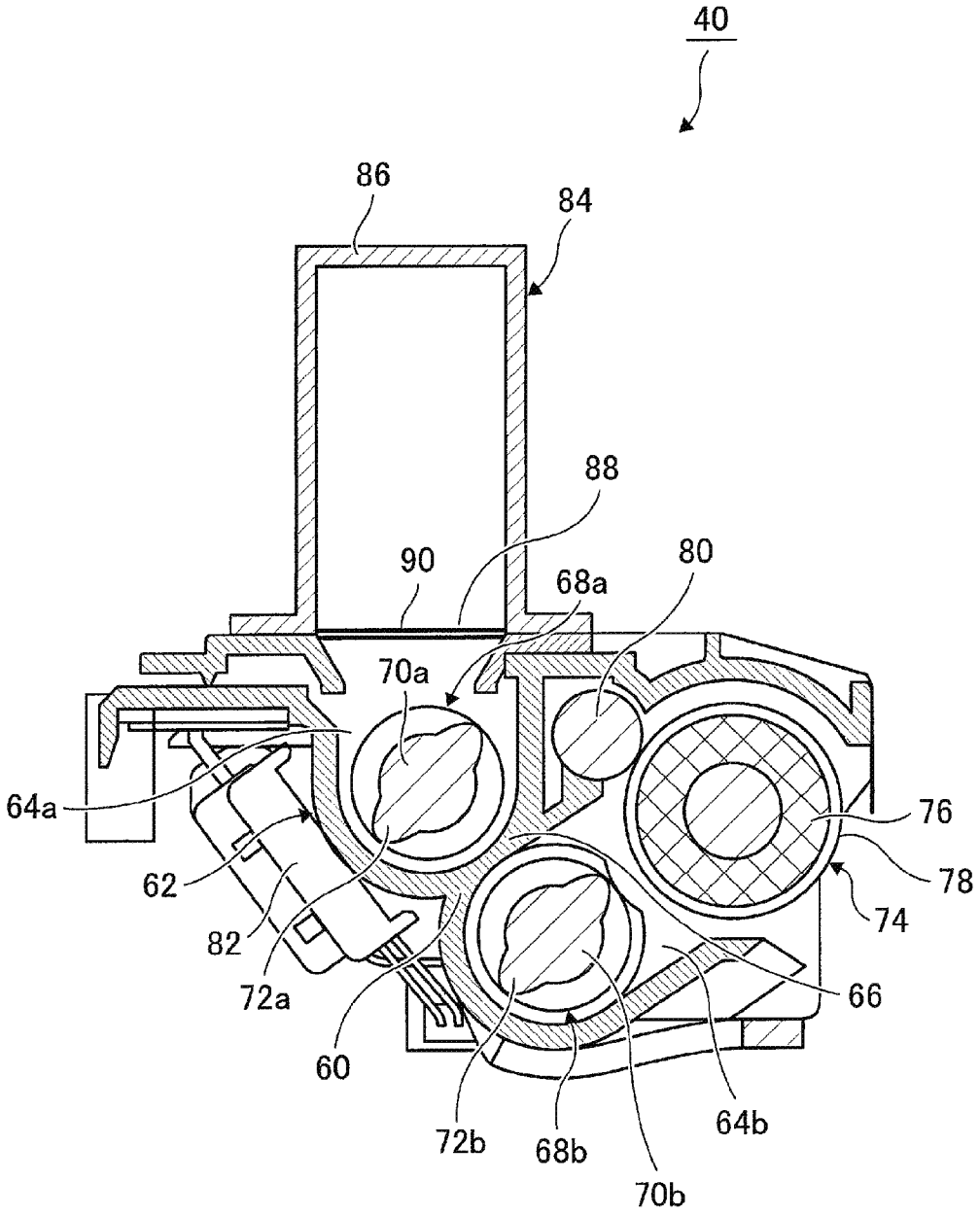
FIG. 2 is a sectional view illustrating a developing device according to the exemplary embodiment of the present disclosure.

FIG. 2 illustrates details of the developing device 40.

The developing device 40 is a two-component developing device that performs developing by charging a toner with agitating the developer including a carrier and the toner.

The developing device 40 includes a developing-device main body 60. A developer transporting unit 62 is provided in the developing-device main body 60. In the developer transporting unit 62, for example, two agitation transporting paths 64*a* and 64*b* are formed along the longitudinal direction of the developing-device main body 60. The agitation transporting paths 64*a* and 64*b* are partitioned in the longitudinal direction by a partition wall 66 and are connected to each other at both end portions of the agitation transporting paths 64*a* and 64*b* in the longitudinal direction. Agitation transporting members 68*a* and 68*b* are disposed on the agitation transporting paths 64*a* and 64*b*. The agitation transporting members 68*a* and 68*b* include rotation shafts

70*a* and 70*b* and agitation transporting portions 72*a* and 72*b* formed in a spiral around the rotation shafts 70*a* and 70*b*. The developer transporting unit 62 is configured to agitate and transport the developer by means of the rotating agitation transporting members 68*a* and 68*b*, and to charge the carrier and the toner.

A developing roll 74 is provided in the developing-device main body 60. The developing roll 74 includes a magnet portion 76 and a sleeve 78. The magnet portion 76 is fixed in the developing roll 74 and forms magnet poles on the circumferential surface. The sleeve 78 rotates around the magnet portion 76. The developing roll 74 faces the image holding member 34 and transfers the toner, deposited on a magnetic brush formed around the sleeve 78, onto the latent image formed on the image holding member 34. A layer thickness regulating member 80 is provided in the developing-device main body 60 to face the developing roll 74. The layer thickness regulating member 80 regulates the layer thickness of the magnetic brush formed on the sleeve 78.

A detection section 82 that detects the amount of the carrier in the agitation transporting path 64*a* is provided outside the developing-device main body 60. The detection section 82 is, for example, a magnetic permeability sensor and detects magnetic permeability to determine the amount of the carrier in the detection range of the agitation transporting path 64*a*.

The developing device 40 has a developer storage unit 84 that stores the developer including the carrier and the toner. The developer storage unit 84 includes a housing 86 connected to the upper portion of the developing device main body 60. The housing 86 is, for example, in the form of a rectangular parallelepiped extending in the longitudinal direction of the developing device main body 60. The housing 86 is connected to the agitation transporting path 64*a* through an opening portion 88. Before the image forming apparatus 10 operates, the opening portion 88 is closed by the closing member 90. The closing member 90 includes a flexible seal.

Next, the developer storage unit 84 will be described in detail.

Figure 3:
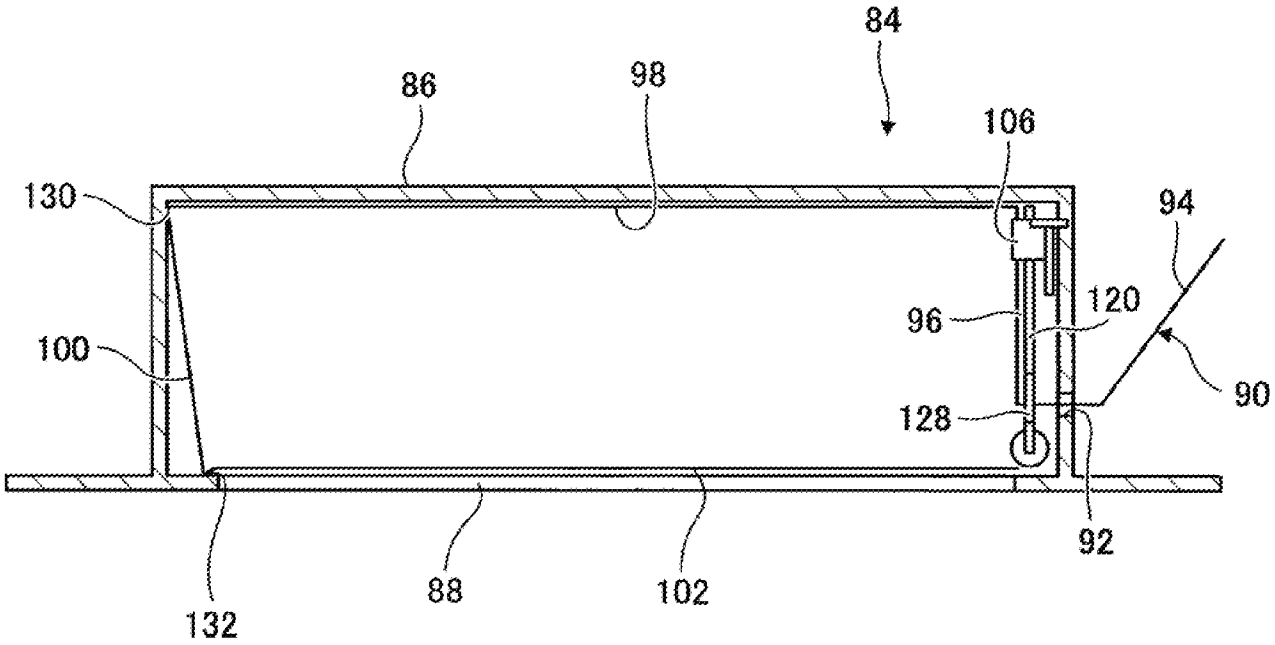
FIG. 3 is a sectional view illustrating a developer storage unit used in the developing device in the exemplary embodiment of the present disclosure.

As illustrated in FIG. 3, the closing member 90 includes a first portion 94, a second portion 96, a third portion 98, a fourth portion 100, and a fifth portion 102. The first portion 94 extends to outside the housing 86 through a first through-hole 92 formed at a lower portion of one side of the housing 86. The second portion 96 is connected to the first portion 94 and reaches one inner upper end of the housing 86 through a supporting body 106 described later. The third portion 98 is connected to the second portion 96 and reaches another inner upper end of the housing 86. The fourth portion 100 is connected to the third portion 98 and reaches another inner upper end portion of the housing 86. The fifth portion 102 is connected to the fourth portion 100 and reaches one inner lower end of the housing 86.

Figure 4:
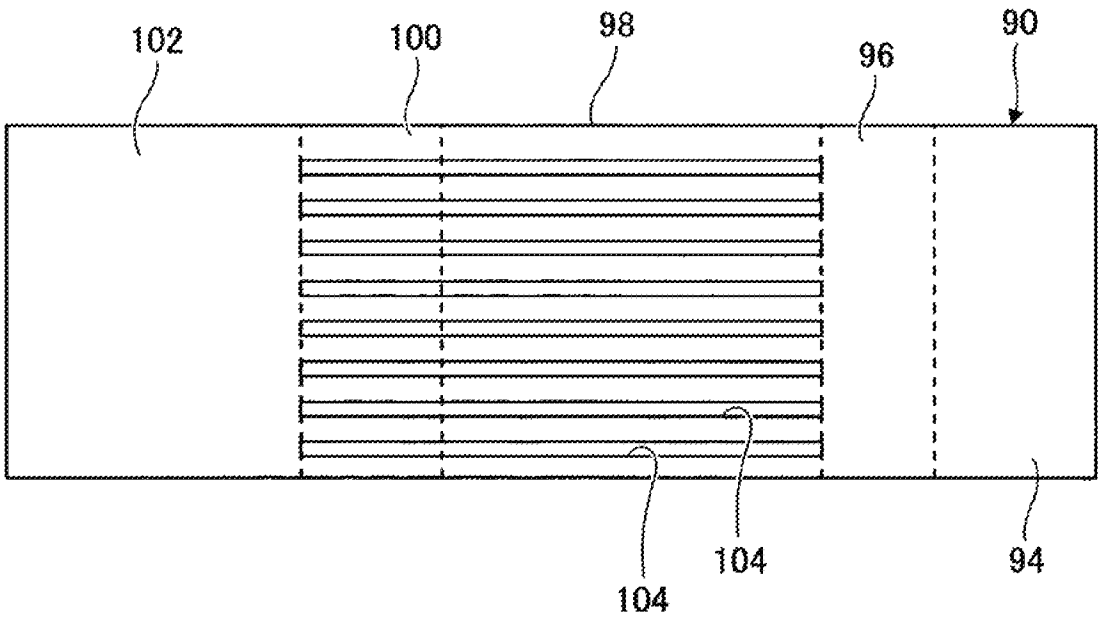
FIG. 4 is a development view illustrating a closing member used in the developing device in the exemplary embodiment of the present disclosure.

As illustrated in FIG. 4, plural grooves 104 are formed in the third portion 98 and the fourth portion 100 of the closing member 90 along the longitudinal direction of the closing member 90. No groove is formed in the fifth portion 102 of the closing member 90 and completely covers the opening portion 88. The groove may or may not be formed in the first portion 94 and the second portion 96 of the closing member 90.

Figure 5:
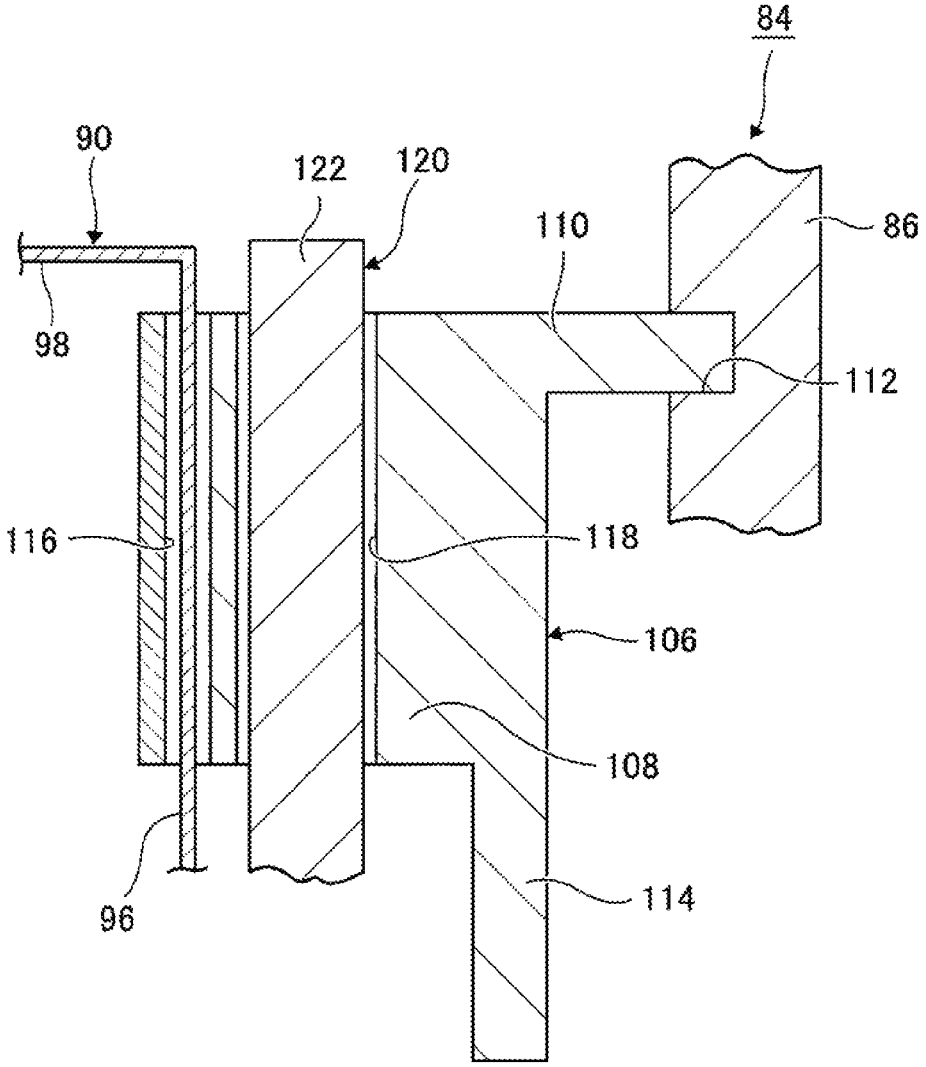
FIG. 5 is a sectional view illustrating a vicinity of a supporting body of the developer storage unit used in the developing device in the exemplary embodiment of the present disclosure.
Figure 6:
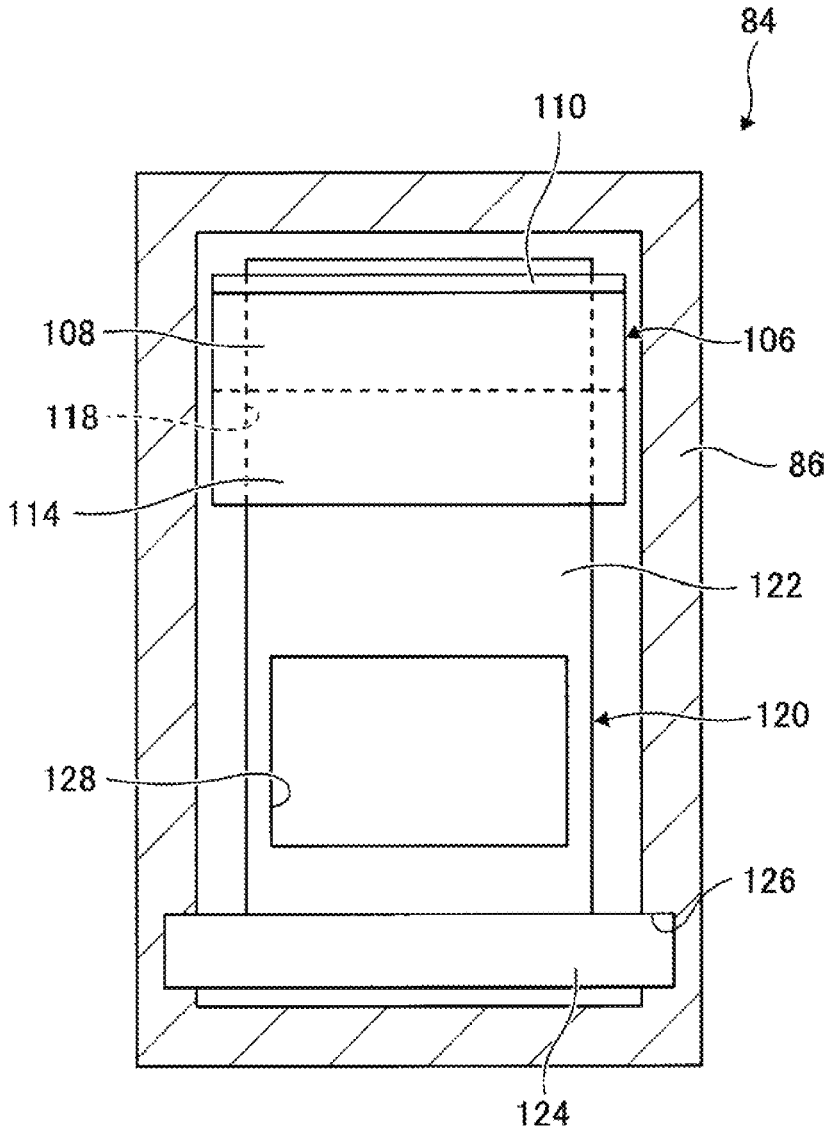
FIG. 6 is a sectional view illustrating a vicinity of a moving body of the developer storage unit used in the developing device in the exemplary embodiment of the present disclosure.

As illustrated in FIGS. 5 and 6, the supporting body 106 has a supporting body main portion 108 formed in a plate shape. A first insertion portion 110 is formed to protrude from the supporting body main portion 108 toward one side. The first insertion portion 110 is inserted into an insertion target portion 112 formed in one side of the housing 86, and thus the supporting body 108 is held by the housing 86. A second insertion portion 114 is formed in the supporting body main portion 108 to protrude downward. As described later, the second insertion portion 114 is inserted into the first through-hole 92 for the closing member when the closing member 90 is separated from the housing 86.

A second through-hole 116 for the closing member is formed in the supporting body main portion 108 of the supporting body 106 to penetrate vertically. The closing member 90 passes through the second through-hole 116 and thus is supported by the supporting body 106.

Further, a through-hole 118 for the moving member is formed in the supporting body main portion 108 of the supporting body 106 to penetrate vertically. A wall portion 122 of the moving member 120 penetrates the through-hole 118 for the moving-member.

As illustrated in FIG. 6, the moving member 120 includes the wall portion 122 and a support shaft 124 provided at a lower portion of the wall portion 122. The support shaft 124 is inserted into support grooves 126 formed at both inner sides of the housing 86 and thus rotatably supports the moving member 120. A third through-hole 128 for the closing member is formed in the wall portion 122, and the closing member 90 is inserted into the third through-hole 128 for the closing member.

As illustrated in FIG. 3, the closing member 90 adheres to another upper end of the housing 86 at a first adhering portion 130 at the boundary between the third portion 96 and the fourth portion 98. The closing member 90 adheres to another lower end of the housing 86 at a second adhering portion 132 at the boundary between the fourth portion 100 and the fifth portion 102. Further, the fifth portion 102 of the closing member 90 adheres to the housing 86 to cover the surroundings of the opening portion 88 of the housing 86.

The closing member 90 is maintained by a first holding force exerted by the insertion of the first insertion portion 110 of the supporting body 106, a second holding force exerted by the adhesion of the first adhering portion 130, and a third holding force exerted by the adhesion of the second adhering portion 132. In this exemplar, embodiment, the second holding force is the smallest, and the first holding force is smaller than the third holding force. Thus, when the closing member 90 is being pulled out, firstly, the first adhering portion 130 is separated from the housing 86. Then, the first insertion portion 110 of the supporting body 106 is detached from the insertion target portion 112, and thus the supporting body 106 rotates around the support shaft 124. Then, the second adhering portion 132 is separated from the housing 86, and further separated from the housing 86 to open the opening portion 88. In the middle of opening the opening portion 88, the supporting body 106 is allowed to slide, with respect to the housing 86, around the opening portion 88 by the closing member 90.

Figure 7:
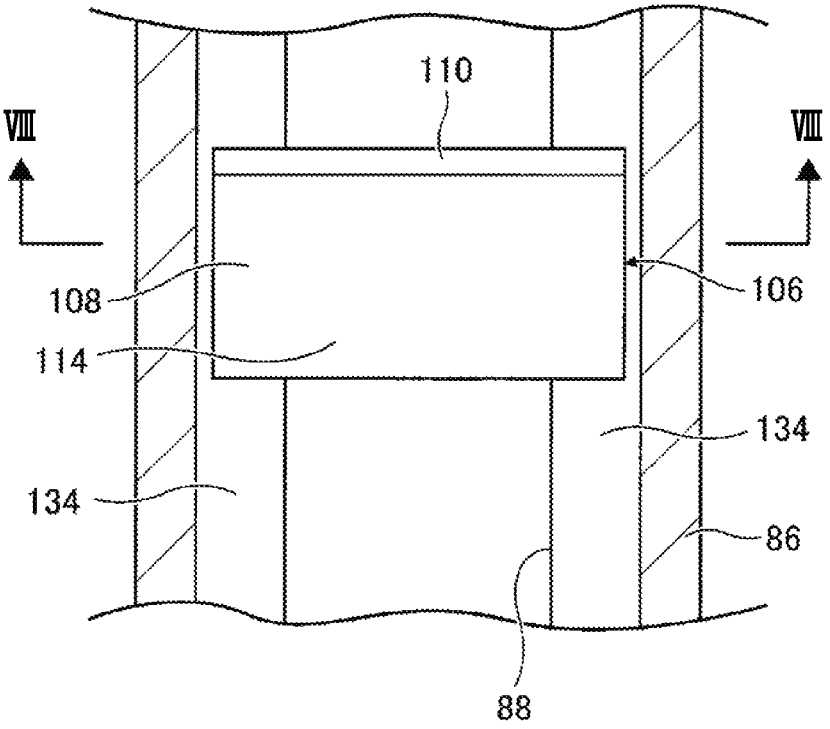
FIG. 7 is a sectional view illustrating a state where the supporting body slides with respect to a housing around an opening portion in the developer storage unit used in the developing device in the exemplary embodiment of the present disclosure, when viewed from a plane direction.
Figure 8:
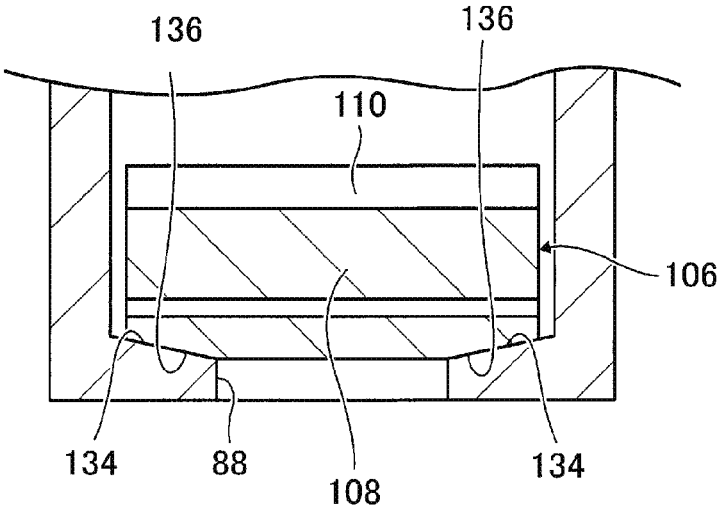
FIG. 8 is a sectional view taken along line VIII-VIII in FIG. 7 and illustrating a state where the supporting body slides with respect to the housing around the opening portion in the developer storage unit used in the developing device in the exemplary embodiment of the present disclosure.

FIGS. 7 and 8 illustrate the supporting body 106 sliding around the opening portion 88 with respect to the housing 86. A guide portion 134 is formed around the opening portion 88 of the housing 86. A sliding portion 136 is formed at the supporting body main portion 108 of the supporting body 106. The sliding portion 136 is guided by the guide portion 134 when the supporting body 106 moves. The guide portion 134 and the sliding portion 136 are formed to be inclined downward toward the opening portion 88, and thus prevent the developer from remaining on the guide portion 134.

In FIGS. 6 to 8, the illustration of the closing member 90 is omitted.

Next, the action of the developer storage unit 84 will be described with reference to FIGS. 9A to 9F.

Figure 9A:
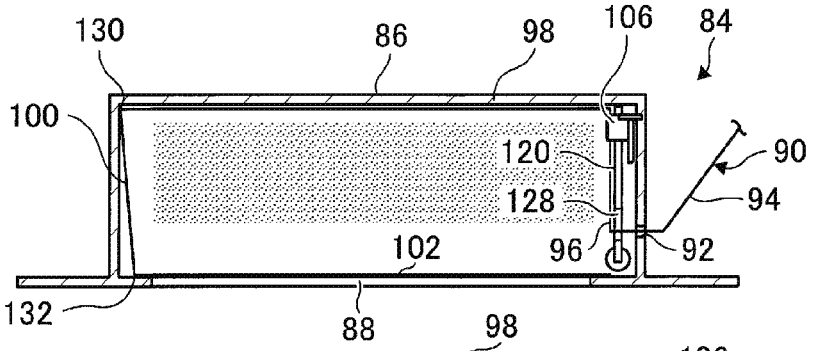
FIGS. 9A to 9F are sectional views illustrating a transition in a case where the closing member is pulled in the developer storage unit used in the developing device in the exemplary embodiment of the present disclosure.

FIG. 9A illustrates a state prior to the transfer of the image forming apparatus 10 to a place for operation by a user. The housing 86 is filled with a developer 138 including a carrier and a toner. When the image forming apparatus 10 is transferred, the developer 138 tends to clump at both inner upper ends of the housing 86 because of shaking or the like during the transfer.

Figure 9B:
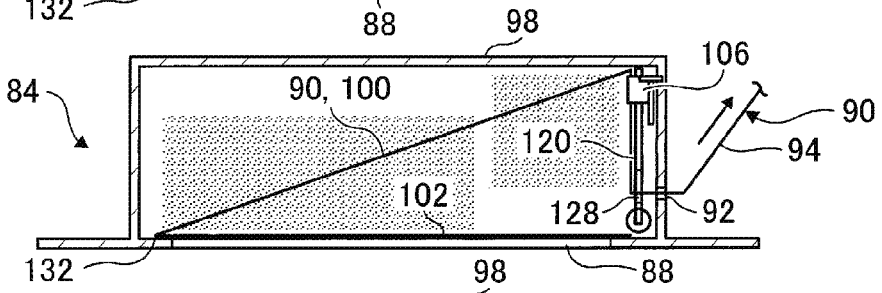

When the image forming apparatus 10 is transferred to the place for operation by the user and then installation of the image forming apparatus is completed, as illustrated in FIG. 9B, the first portion 94 of the closing member 90 is pulled in a right direction in FIG. 9B. When the closing member 90 is pulled, the first adhering portion 130 in the closing member 90 is first separated from the housing 86 because the holding force of the first adhering portion 130 is the weakest. When the first adhering portion 130 is separated from the housing 86, a lump of the developer 138 at another inner upper end of the housing 86 is loosened by the third portion 98 and the fourth portion 100 of the closing member 90. The loosened part of the developer moves to behind the third portion 98 and the fourth portion 100 of the closing member 90 through the groove 104 or a gap around the closing member 90.

Figure 9C:
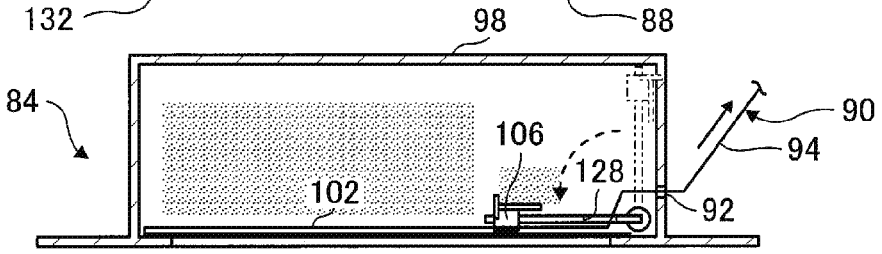

When the closing member 90 is further pulled, the supporting body 106 having the weakest holding force next to the holding force of the first adhering portion 130 is separated from the housing 86. As illustrated in FIG. 9C, the supporting body 106 and the moving member 120 rotate and move together to the vicinity of the opening portion 88. When the supporting body 106 and the moving member 120 rotate, a clump of the developer 138 at one inner upper end of the housing 86 is loosened. The loosened part of the developer moves to behind the supporting body 106 and the moving member 120. A part of the developer 138 remaining on another side also moves to behind the third portion 98 and the fourth portion of the closing member 90.

Figure 9D:
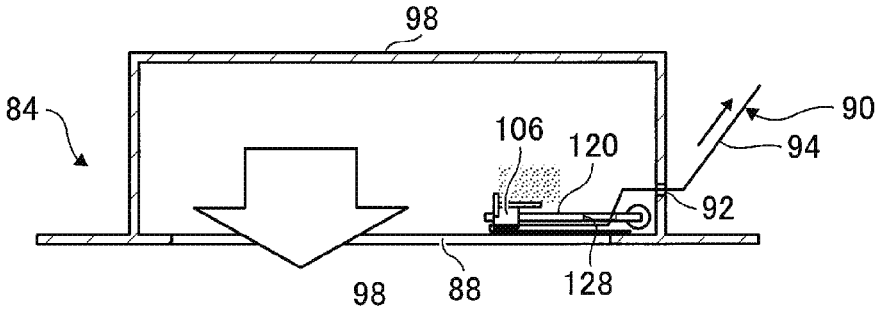

When the closing member 90 is further pulled, the second adhering portion 130 is separated from the housing 86, and the opening portion 88 starts to be opened. When the opening portion 88 starts to be opened, as illustrated in FIG. 9D, a part of the developer on another side is allowed to fall to the agitation transporting path 64*a* through the opening portion 88.

Figure 9E:
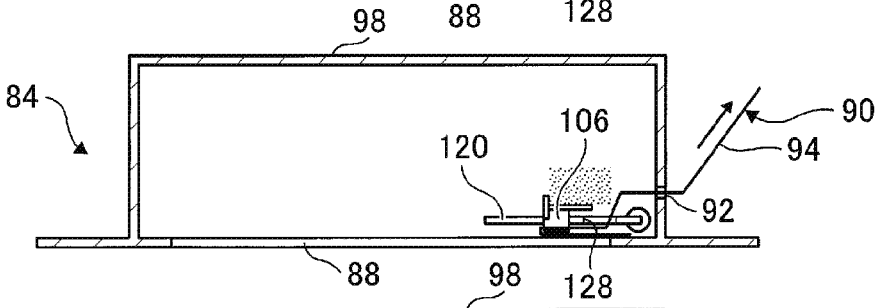

In that way, the part of the closing member 90 in the housing 86 becomes shorter, and the closing member 90 comes into contact with the supporting body 86. When the closing member 90 is further pulled from this position, as illustrated in FIG. 9E, the supporting body 86 hooked on the closing member 90 moves to one side.

Figure 9F:
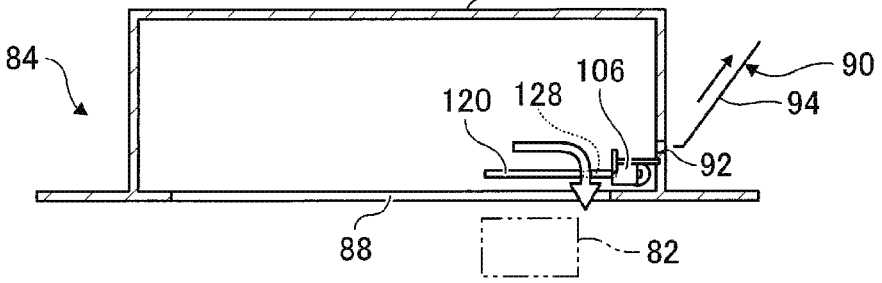

When the closing member 90 is further pulled, as illustrated in FIG. 9F, finally, the closing member 90 allows the opening portion 88 to fully open and moves the supporting body 106 until the second insertion portion 114 of the supporting body 106 is inserted into the first through-hole 92 for the closing member. When the supporting body 106 is moved, the third through-hole 128 for the closing member in the moving member 120 is opened, and the third through-hole 128 for the closing member is connected to the opening portion 88. When the third through-hole 128 for the closing member is connected to the opening portion 88, the part of the developer remaining on the supporting body 106 and the moving member 120 is allowed to fall to the agitation transporting path 64*a* through the third through-hole 128 and the opening portion 88.

The developing device 40 starts development using the developer allowed to fall to the agitation transporting path 64*a*. When the toner is running short as the developing device 40 further performs development, the toner is supplied from a toner bottle (not illustrated) to compensate for the shortage.

If a clump of the developer remains at both upper ends of the developer storage unit 84, the amount of the carrier may be insufficient, and the toner may fail to be supplied in an amount for a predetermined toner concentration from the toner bottle, so that a trouble may occur to cause a carrier development (a phenomenon in which the carrier moves toward the image holding member). In this exemplary embodiment, such a trouble is prevented because a clump of the developer is loosened at both upper ends of the developer storage unit 84 so that the developer is allowed to fall to the agitation transporting path 64*a*, which allows a predetermined amount of the carrier to be supplied.

As illustrated in FIG. 9F, after the closing member 90 is pulled out, the moving member 120 is left as a covering member that covers part of the opening portion 88. The detection section 82 described above is disposed at a longitudinal position where the moving member 120 is left. The developer agitated and transported in the agitation transporting path 64*a* tends to overflow from the agitation transporting path 64*a* toward the developer storage unit 84. The moving member 120 prevents such displacement of the developer toward the developer storage unit 84. If the developer overflows from the agitation transporting path 64*a* toward the developer storage unit 84, the detection section 82 detects that the amount of the carrier is relatively large. However, the amount of the carrier in the agitation transporting path 64*a* is correctly detected, because the moving member 120 prevents the displacement of the developer toward the developer storage unit 84.

The above exemplary embodiment has shown an example in which the developing device is provided alone in the image forming apparatus. The exemplary embodiment may also be applied to a case where the developing device is integrated with the image holding member, the exposure unit, or other components to form a unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer storage unit that stores a developer;

a developer transporting unit that is connected to the developer storage unit through an opening portion;

a closing member that openably closes the opening portion; and a loosening section that acts simultaneously with opening of the opening portion by the closing member to loosen the developer at an inner end portion of the developer storage unit, opposite to the opening portion, wherein a portion of the loosening section is disposed in the developer storage unit.

2. The developing device according to claim 1, wherein the loosening section includes a part of the closing member extending over an area including the inner end portion of the developer storage unit, opposite to the opening portion.

3. The developing device according to claim 1, wherein the loosening section includes a moving member that moves simultaneously with opening by the closing member.

4. The developing device according to claim 3, wherein the moving member moves to close at least a part of the opening portion when the opening portion is opened.

5. The developing device according to claim 4, wherein the developer stored in the developer storage unit is a two-component developer including a toner and a carrier, the developing device further comprising a detection section that detects the amount of the carrier in the developer transported by the developer transporting unit, the detection section being disposed at a position facing the part of the opening portion closed by the moving member.

6. A developing device comprising:

a developer storage unit that stores a developer;

a developer transporting unit that is connected to the developer storage unit through an opening portion; and a closing member that openably closes the opening portion, wherein the closing member extends over an area including an inner end portion of the developer storage unit, opposite to the opening portion.

7. A developing device comprising:

a developer storage unit that stores a two-component developer including a toner and a carrier;

a developer transporting unit that is connected to the developer storage unit through an opening portion;

a closing member that openably closes the opening portion;

a covering member that covers at least a part of the opening portion after the opening portion is opened by the closing member; and a detection section that detects the amount of the carrier in the developer transported by the developer transporting unit, wherein the detection section is disposed at a position facing the covering member.

8. The developing device according to claim 7, wherein the covering member is a moving member that moves simultaneously with opening by the closing member.

9. An image forming apparatus comprising:

an image holding member that holds a developer; and a developing device that develops a latent image formed on the image holding member, the developing device including:

a developer storage unit that stores the developer;

a developer transporting unit that is connected to the developer storage unit through an opening portion;

a closing member that openably closes the opening portion; and a loosening section that acts simultaneously with opening of the opening portion by the closing member to loosen the developer at an inner end portion of the developer storage unit, opposite to the opening portion, wherein a portion of the loosening section is disposed in the developer storage unit.

10. An image forming apparatus comprising:

an image holding member that holds a developer; and a developing device that develops a latent image formed on the image holding member, the developing device including:

a developer storage unit that stores the developer;

a developer transporting unit that is connected to the developer storage unit through an opening portion; and a closing member that openably closes the opening portion, wherein the closing member extends over an area including an inner end portion of the developer storage unit, opposite to the opening portion.

11. An image forming apparatus comprising:

an image holding member that holds a developer; and a developing device that develops a latent image formed on the image holding member, the developing device including:

a developer storage unit that stores a two-component developer including a toner and a carrier;

a developer transporting unit that is connected to the developer storage unit through an opening portion;

a closing member that openably closes the opening portion, a covering member that covers at least a part of the opening portion after the opening portion is opened by the closing member; and a detection section that detects the amount of the carrier in the developer transported by the developer transporting unit, wherein the detection section is disposed at a position facing the covering member.

* * * * *